United States Patent [19]

Andrei-Alexandru et al.

[11] 4,427,929

[45] Jan. 24, 1984

[54] WINDOW AND DOOR LOCKING SYSTEM FOR VEHICLES

[75] Inventors: Marcel Andrei-Alexandru; Hans Prohaska, both of Bietigheim-Bissingen, Fed. Rep. of Germany

[73] Assignee: ITT Industries, Inc., New York, N.Y.

[21] Appl. No.: 369,261

[22] Filed: Apr. 16, 1982

[30] Foreign Application Priority Data

Apr. 28, 1981 [DE] Fed. Rep. of Germany ..... 3116691

[51] Int. Cl.[3] ..... F05B 47/00

[52] U.S. Cl. ..... 318/282; 180/289; 280/289 L; 307/10 AT

[58] Field of Search ..... 318/282, 256, 264–267, 318/103; 180/286–287, 289; 280/289 L; 200/61.62, 61.64, 61.66; 49/24, 35; 292/201, 198, 199; 340/63; 307/10 AT; 335/77

[56] References Cited

U.S. PATENT DOCUMENTS 3,723,967 3/1973 Atkins et al. ..... 180/289

3,735,833 5/1973 Sutkowski ..... 307/10 AX 4,125,008 11/1978 Genest et al. ..... 70/279

4,240,516 12/1980 Henderson ..... 340/63

4.358,718 5/1980 Pritchard ..... 70/279

*Primary Examiner*—J. V. Truhe

*Assistant Examiner*—A. Evans

*Attorney, Agent, or Firm*—James B. Raden; William J. Michals

[57] ABSTRACT

A synchronizing circuit for a combination window and door locking system for automotive vehicles. During normal operation the door's are locked and unlocked by continued rotation of the window lifter motor. If the door locks have been manually operated between motorized operations, the locked and unlocked positions of the door locks can become out of synchronization with one another. The synchronization circuit utilizes and interconnected series of switches, position-sensitive switches and relays to control the window lifter motors. During a locking operation, the circuit automatically sequences the lifter motors first through an unlocking operation and then into their door locking positions.

4 Claims, 2 Drawing Figures

A
B
S1
S2

WINDOW AND DOOR LOCKING SYSTEM FOR VEHICLES

BACKGROUND OF THE INVENTION

This invention starts from a circuit arrangement for a reversible electric motor supplied from a voltage source, which motor serves for driving a door locking element in motor vehicles and, for locking and unlocking the vehicle door, may be switched on via an operating switch.

So-called central door locking systems including electric drive elements are normally mechanically built up in such a way that a motor vehicle door can be locked or unlocked both electrically and manually completely independently. However, this can involve problems when the locking condition of the door at the beginning of a central control of the electric motors does not correspond to the condition it had after the latest displacement of the door locking element by the electric motors, when an uneven number of manual operations had thus been effected.

So for instance from the German laid open print 2,854,713 a combined window lifter and central door locking system is known in which, for locking and unlocking of a vehicle door, the entire electric motor is swivelled round its driven shaft. If in such a system it is provided to adjust the door locking element manually it is, for instance, possible, to unlock the door manually after the door was locked by the electric motor previously. The door locking element is then in a position which corresponds to the unlocked door, but the electric motor occupies a position which corresponds to the locked door.

A circuit arrangement for a combined window lifter and central door lockiing system known from the DE-OS 2,854,713 is shown by the DE-OS 2,854,670. This circuit arrangement is laid out in such a way that the electric motor for opening and closing of the window in a door may be controlled through a reversing switch in the interior of the motor vehicle. When the window will be completely closed also the respective door will be locked, because a position switch assigned to the motor and operated by it will only change over upon termination of the locking operation. When the window will be opened at first the door will be unlocked, before the window pane will be moved. In addition thereto all electric motors can be controlled simultaneously through one or several operating switches in order to lock or unlock all doors, whereby prior to a locking operation all possibly open windows will be closed.

Now the following can happen. The driver unlocks all doors before he enters the vehicle. En route the driver opens the window of the driver's door by the electric motor and then closes it again. During this closing operation also the door is locked. Thus the electric motor in the driver's door occupies a position which corresponds to the locked door, whereas the electric motors in the other doors occupy positions which correspond to the unlocked doors. Before the driver gets off the vehicle he unlocks his door manually. The electric motor therefore retains the locking position. When the driver now wishes to lock the doors by the electric motors the driver's door remains unlocked, because the electric motor concerned cannot be swivelled further.

It is an object of the present invention to develop a circuit arrangement according to the present invention in such a way that it can be operated simply and ensures a high operational reliability. Thereby first of all it is to be ensured that after a locking command has been given all doors will be actually locked.

SUMMARY OF THE INVENTION

In a circuit arrangement including the features of the present invention this problem is solved according to the invention that upon a single operation of the switch the electric motor, in order to synchronise the positions of its movable parts with the position of the door locking element, may at first be controlled in the one direction of rotation and then, in order to adjust the door locking element, in the other direction of rotation. Thus the door locking element is in any case reliably adjusted by a circuit arrangement developed in such a way. Thereby the operating switch has only to be moved in a direction which corresponds to the desired change of the condition on the door, so that the system can be operated easily.

Advantageous developments of the invention are also provided. So according to the invention also the electric motors which already occupy the desired end position carry out the same movement. Therefore, there is no difference to be made between electric motors in locked doors and in unlocked doors, so that they can all be controlled in the same way and the circuit arrangement is thereby simplified. The circuit arrangement according to the invention can be enlarged in such a way that the window of a vehicle door can be opened and closed by a single electric motor which also locks and unlocks the vehicle door itself. In order not to make the circuit arrangement too complicated according to the invention the control of the electric motor which effects a reversion is only provided for locking operations. Thus it is in any case ensured that the vehicle is locked and the locking operation is simple. Moreover in a system in which the full closing of the window pane in a door is connected with a locking operation the asynchronous position between electric motor and door locking element mainly appears before a locking operation.

A proper control of the electric motor is advantageously achieved according to the invention in that the position of the electric motor with respect to the desired direction of displacement of the locking element may be detected by a sensor and that this sensor controls switching means which until the synchronisation make the electric motor run in the one direction of rotation and thereafter in the other direction of rotation. According to the invention the first terminal of the electric motor is connected to a position switch actuated by the electric motor and developed as a two-way snap-action switch with hysteresis. This two-way snap-action switch has mainly the function to short-circuit the electric motor after an unlocking operation has been carried out which had previously been released via the opening switch. In an advantageous manner the position of the switch contact of the two-way snap-action switch simultaneously serves for identifying the position of the electric motor. When, for example, the operating switch is actuated in order to effect a locking of the vehicle doors, the sensor detects whether the switch contact of the two-way snap-action switch occupies a position corresponding to a locked door or a position corresponding to an unlocked door. In the first case the electric motor is at first controlled in the one direction of rotation and then in the other direction of rotation. In the latter case the electric motor immediately rotates in a direction of rotation which effects a locking of the vehicle.

Other embodiments include developments of a circuit arrangement according to the invention relating to how the two-way snap-action switch can advantageously be coupled with the sensor and how it can be used to reverse the electric motor.

Other embodiments refer to advantageous developments of a circuit arrangement according to the invention in which the sensor and the switching means are realised by relays. By the short-circuit of the current relay serving as a sensor it is prevented, that the door, by turns, is continuously locked and unlocked, when the operating switch is held in an operating position.

Other forms include features which permit an advantageous connection of the electric motor and of the two-way snap-action switch to the other parts of the circuit arrangement. By a development according to the invention according to which the second input contact of the two-way snap-action switch may directly be connected to one terminal of the voltage source via an additional, third bridging contact of the reversing switch, is thus ensured that the door can be unlocked again and the window can be opened again via the reversing switch provided they were previously locked and closed via the reversing switch. Thereby the door has not to be unlocked via the operating switch at first. A development according to the invention ensures that the individual motors are separated from one another, when only one motor is to be controlled via the reversing switch in question.

By the advantageous development according to the invention it is ensured that only control currents for the power stages have to flow through the operating switch and thus its contacts are only insignificantly worn. If one takes the bad with the good and allows high currents to flow through the operating switch the circuit arrangement can additionally be simplified by a development according to the present invention.

BRIEF DESCRIPTION OF THE DRAWINGS

Two embodiments of a circuit arrangement according to the invention are shown in the drawing. The invention is now described in detail by way of these embodiments, in which.

DETAILED DESCRIPTION

Figure 1:
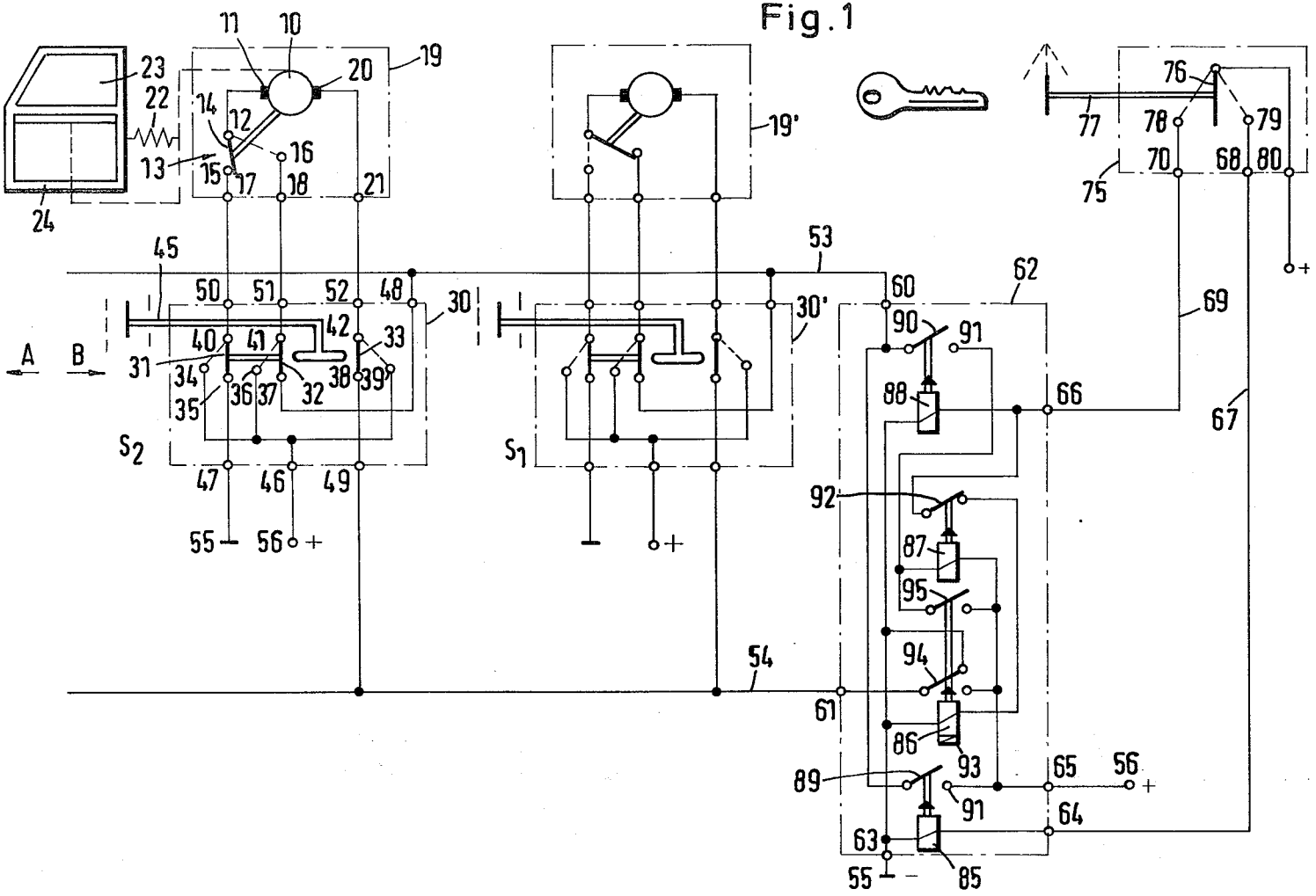
FIG. 1 is a version including a current relay as a sensor for the position of the electric motor, comprising a second relay controlled by the current relay and including two further relays serving as power stages

In the circuit diagrams the electric motors are designated by 10. One each of these motors is positioned in a door 24 of a motor vehicle and serves to displace the window pane 23 of this door 24 and to unlock and lock the door 24 itself. The one terminal 11 of each motor 10 is connected to the centre contact 12 of a position switch 13 which is directly or indirectly actuated by the electric motor 10 and developed as a two-way snap-action switch with hysteresis. The position switch 13 cannot be adjusted, when the door locking element 22 is manually adjusted. The bridging contact 14 of the position switch 13 is connected with the make-break contact 15 or the make-break contact 16 which are connected to the outputs 17 and 18 of the motor unit 19. The second terminal 20 of the motor 10 is connected to the output 21 of the motor unit 19.

To each motor unit 19 a reversing switch 30 is assigned which includes three movable bridging contacts 31, 32 and 33 and the stationary contacts 34 to 42. Each of these bridging contacts 31 to 33 is developed as a change-over contact which is permanently connected with the corresponding stationary contact 40, 41 or 42 and can be changed over between the make-break contacts 34 and 35, 36 and 37 or 38 and 39. The switching member 45 serves to actuate the bridging contacts 31 to 33, which switching member can be moved in the one or other position from the central rest position. The bridging contacts 31 to 33 are coupled with the switching member 45 in such a way that upon a movement in the one direction only the bridging contacts 31 and 32 are actuated, whereas the bridging contact 33 remains in the rest position and upon a movement in the other direction only the bridging contact 33 is moved, whereas the two other bridging contacts are in the rest position. The stationary contacts 34, 36 and 39 are connected with only one input 46 of the reversing switch 30. The stationary contact 35 is connected to the input 47, the stationary contact 37 to the input 48 and the stationary contact 38 to the input 49. The stationary contacts 40, 41 and 42 appear as the outputs 50, 51 and 52 of the reversing switch 30 and are separately connected with one of the inputs 17, 18 and 21 of the motor unit 19. The input 47 of the reversing switch 30 is supplied with negative potential, the input 46 is supplied with positive potential. The inputs 48 and 49 each are connected to a collecting main 53 or 54 which is conducted from one output 60 or 61 of a central control device 62 to each reversing switch 30.

The control device 62 has a total of four inputs 63 to 66, whereby the input 63 is connected to earth 55, the input 65 to the positive terminal 56 of the voltage source, the input 64 via a lead 67 to a first output 68 of the operating switch 75 and the input 66 via a lead 69 to a second output 70 of the operating switch 75. The operating switch 75 is developed as a two-way snap-action switch with neutral position. From the neutral position its bridging contact 76 can either be connected to the make-break contact 78 or to the make-break contact 79 by means of the handle 77. The bridging contact 76 itself is connected to the positive pole 56 of the voltage source via the output 80. If the handle 77 of the operating switch 75 is released after it has been operated it returns automatically into the neutral position together with the bridging contact 76. This is also valid for the handle 45 and the bridging contacts 31 to 33 of the reversing switch 30.

A total of four relays 85 to 88 are accomodated in the central control device 62. The coil of the relay 85 is inserted between the input 64 and the output 63, the coil of the relay 88 between the input 66 and the output 63 of the control device 62. The two relays mentioned thus can be directly excited through the operating switch 75. Both relays have a switch contact 89 or 90 serving as a make contact which is connected to the output 60 of the control device. The make contact 91 of the relay 85 is directly connected to the input 65 of the control device 62, the make contact 91 of the relay 88 via the coil of the relay 87.

The relay 87 is a current relay and serves as a sensor for the position of the bridging contact 14 of the position switches 13, when a locking operation is to be initiated via the operating switch 75. The relay 87 has a switch contact 92 acting as a break contact through which, when it is closed, the one side of the coil of the relay 86 is connected to the input 66. The other side of the coil of the relay 86 is connected to the input 63. In order to provide that the relay 86 is excited a given time after the relay 88, the relay 86 is equipped with a slow-operation device 93. The relay 86 has a switch contact 94 which is connected to the output 61 and which connects this output 61 either with the input 63 or with the input 65. When the relay 86 is not excited, there is a connection between the output 61 and the input 63. When the relay 86 is excited the coil of the current relay 87 is short-circuited with a second switch contact 95 of the relay 86, which serves as a make contact.

In order to explain the mode of operation the conditions shown in the drawing are described at first. The reversing switch 30 and the operating switch 75 are in the rest position. The bridging contact 14 of the one position switch connects the contacts 12 and 15, whereas the bridging contact 14 of the position switch 13 of the other motor unit having no reference numerals connects the two contacts 12 and 16. The switch contacts 89 and 90 of the two relays 85 and 88 are open, so that the collecting main 53 is free from potential. The collecting main 54 carries ground potential. The bridging contact 31 in the reversing switch connects the two stationary contacts 40 and 35, the bridging contact 32 the two stationary contacts 41 and 37 and the bridging contact 33 the two stationary contacts 42 and 38. It is assumed that the door 24 to which the motor unit having a reference numeral is assigned is unlocked, its window at least partly open. The window assigned to the other motor unit is closed and the door locked.

When now the switching member 45 of the reversing switch 30 is moved in the direction of arrow A the terminal 11 of the motor is applied to the positive pole 56 of a voltage source via the bridging contact 14 of the position switch 13 and the bridging contact 31 of the reversing switch 30 and the terminal 20 of the electric motor 10 is applied to earth via the bridging contact 33 of the reversing switch 30, the collecting main 54, the switch contact 94 of the relay 86 and the output 63 of the control device 62. The window pane is moved downwards. When the handle 45 is released, the bridging contact 31 is again positioned on the stationary contact 35. This results in a short-circuit braking of the motor 10.

When the window is to be moved upwards from a partly open position, the switching member 45 of the reversing switch 30 is moved in the direction of arrow B. The terminal 11 is thereby continued to be supplied with earth potential, whereas the terminal 20 is applied to the positive pole 56 of the voltage source via the bridging contact 33 of the reversing switch 30. The motor rotates in the reverse direction and the window pane is moved upwards. When the switching member 45 is permitted to return to its rest position before the window is completely closed, the motor is short-circuited. When, in contrast thereto, the switching member retains its position the window is at first fully closed and then the door 24 is locked by the motor 10. At the end of the locking operation the position switch snaps over, so that its bridging contact 14 now interconnects the two stationary contacts 12 and 16 and connects the terminal 11 of the motor to the collecting main 53 via the bridging contact 32 of the reversing switch 30. The collecting main 53 is free from potential, so that the motor is stopped. When now the window is to be opened, the switching member 45 is again moved in the direction of arrow A. Until the unlocking of the door is terminated, thus until the time at which the position switch snaps over into the position shown again, the motor 10 is supplied with voltage via the bridging contact 32 of the reversing switch 30, thereafter via the bridging contact 31 of the reversing switch 30.

Now it is assumed that all windows of the motor vehicle are closed and all doors are locked. All bridging contacts 14 of the position switch 13 connect the contacts 12 and 16. In order to unlock the door the bridging contact 76 of the operating switch 75 is switched on the stationary contact 79. Thereby the relay 85 is excited and its switch contact 89 connects the output 60 of the control device 62 to the input 65. Thus the terminal 11 of the electric motor is connected to the positive pole 56 of the voltage source via the collecting main 53, the bridging contacts 32 of the reversing switches and the bridging contacts 14 of the position switches, the terminal 20 of the electric motor 10 is connected to earth via the bridging contact 33 of the reversing switch, the collecting main 54 and the switch contact 94 of the relay 86. The motor rotates and unlocks the door. At the end of the unlocking operation the position switch 13 of each door snaps over and and short-circuits the motor via its bridging contact 14 and the bridging contact 31 of the assigned reversing switch 30. Thus it is excluded that the window opens with an unlocking operation.

For a locking of the doors the briding contact 76 of the operating switch 75 is connected to the stationary contact 78. The bridging contacts 14 of all position switches 13 connect the stationary contacts 12 and 15. The relay 88 becomes excited and connects the output 60 of the control device with the input 65 via the current relay 87. But due to the position of the position switches 13 the current relay 87 is not included in a closed circuit and is therefore not excited. Via the switch contact 92 of the relay 87 the relay 86 is connected to the input 66 which due to the position of the operating switch 75 carries positive potential. The relay 86 becomes excited and its switch contact 94 switches positive potential on the collecting main 54. Therefore the electric motor 10 with its terminal 20 is applied to the positive pole via the bridging contact 33 of the respective reversing switch 30 and to earth with its terminal 11 via the bridging contact 14 of the assigned position switch 13 and the bridging contact 31 of the respective reversing switch 30. The doors are locked. At the end of the locking operation the position switches 13 change over and short-circuit the motors via the bridging contact 32 of the reversing switch 30, the collecting main 53, the closed switch contact 90 of the relay 88 and the relay 87 and the closed switch contact 95 of the relay 86 connected in parallel thereto. The short-circuit of the relay 87 via the switch contact 95 prevents that it becomes excited after a change-over of a position switch. When before a motor-driven locking at least one door has been manually unlocked, at least one position switch 13 occupies a position in which its bridging contact 14 interconnects the two stationary contacts 12 and 16. Such a position is shown in the motor unit 19. When now the operating switch 75 is actuated to lock the unlocked doors and thereby the bridging contact 76 is connected to the stationary contact 78 the relay 88 again becomes excited at first and via the current relay 87 effects a connection between the output 60 and the input 65 of the control device 62. Due to its slow-operation device 93 the relay 86 at first retains the non-excited condition. Due to such position switch or such position switches the bridging contact 14 of which interconnects the two stationary contacts 12 and 16 the current relay 87 is now included in a closed circuit. It therefore opens its switch contact 92. Thus the relay 86 can no longer become excited. The motors 10 are applied to earth with their terminal 20 via the bridging contact 33 of the respective reversing switch, the collecting main 64 and the switch contact 94 of the relay 86. The other terminal 11 of the motors in which the bridging contact 14 of the position switch 13 interconnects the two stationary contacts 12 and 16 is supplied with positive potential via the bridging contact 32 of the respective reversing switch 30, the collecting main 53, the switch contact 90 of the relay 88 and the current relay 87. The other terminal 11 of the motors in which the bridging contact 14 of the position switch 13 interconnects the two stationary contacts 12 and 15 is connected to earth via the bridging contact 31 of the assigned reversing switch. The last mentioned motors occupy a position which corresponds to an unlocked door. The other motors occupy a position, which corresponds to a locked door, in which case however at least one of these doors has been manually unlocked. Now the motors whose position correspond to a locked door begin to rotate in a direction which normally effects an unlocking of a door. Thereby the doors are at first unlocked in which the position of the electric motor and the door-locking element correspond to each other. The doors in which the position of the electric motor correspond to a locked door, but the door is unlocked, the motor runs idle into its unlocked position. As soon as all position switches are changed over, so that all bridging contacts 14 interconnect the two stationary contacts 12 and 15, the circuit of the current relay 87 is interrupted. This relay is de-energised, so that after a short time the relay 86 becomes excited and changes over its switch contact 94. Now the terminals 20 of all electric motors are applied to the positive pole of the voltage source via the switch contact 94, the collecting main 54 and the bridging contact 33 of the assigned reversing switch 30. The terminals 11 of all motors is connected to earth via the bridging contact 14 of the position switch 13 and the bridging contact 31 of the reversing switch 30. The motors therefore reverse their direction of rotation, so that all doors are locked. The current relay, however, cannot be excited, because it is short-circuited via the switch contact 95 of the relay 86.

Figure 2:
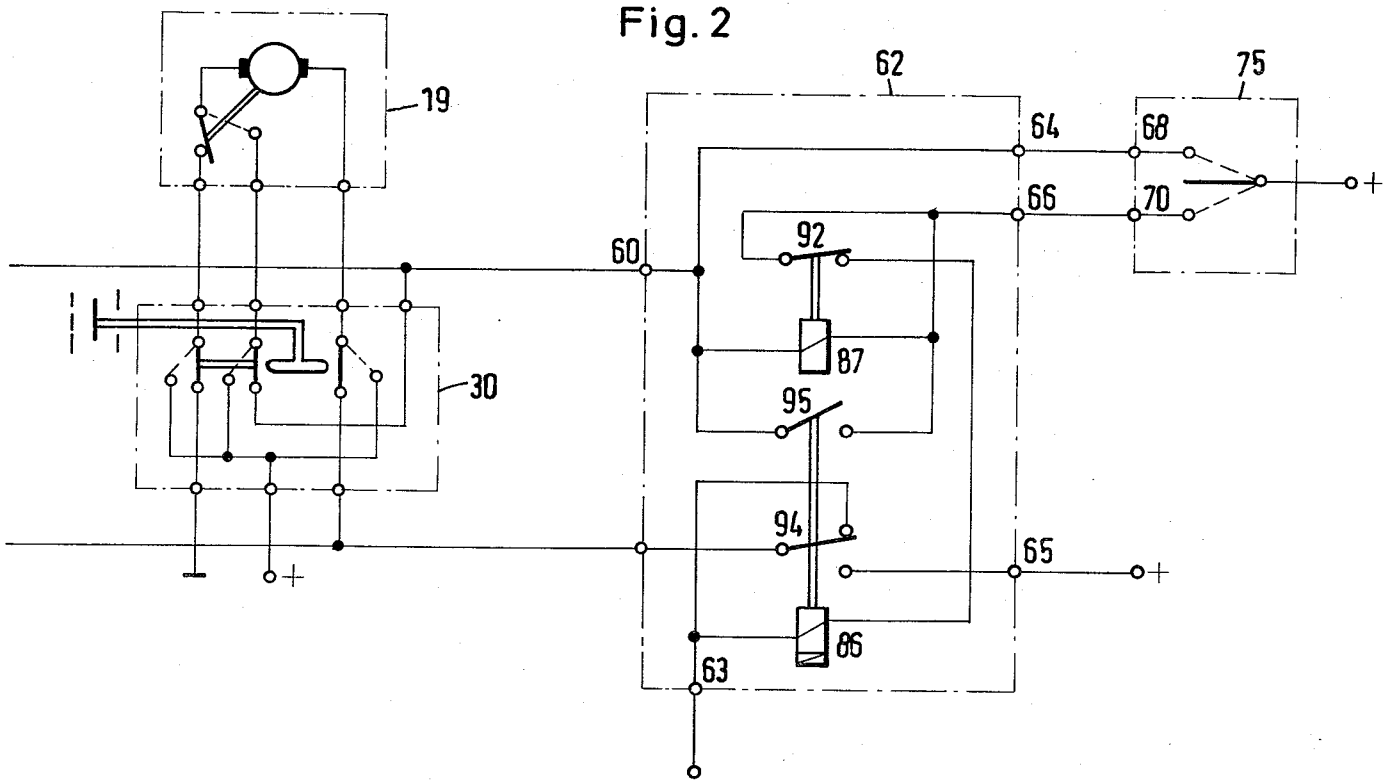
FIG. 2 is a version in which the motor currents flow via the operating switch.

In the circuit arrangement according to FIG. 2 the electric connections within the motor unit 19 and within the reversing switch 30 and the interconnections between these to units and the connections to other components are completely the same as in FIG. 1. But in the control device the two relays 85 and 88 are omitted. The input 64 is directly connected to the output 60 and the input 66 is connected to the output 60 via the current relay 87 and perhaps via the switch contact 95 of the relay 86 connected in parallel to the coil of the relay. One side of the coil of the relay is connected to the input 66 again via the switch contact 92 of the current relay 87 and the other side to the output 63 of the control device 62. The switch contact 94 of the relay 86 changes over between the input 63 and the input 65.

The mode of operation of the circuit arrangement according to FIG. 2 is the same as that of the circuit arrangement according to FIG. 1. It is therefore not necessary to describe it in detail. The only difference is that now the motor currents flow via the contacts of the operating switch, when the door is unlocked.

What is claimed is:

1. A control circuit for synchronizing the operation of a combined manual and motor-driven door locking mechanism system having a plurality of reversible motors each of which are respectively assigned to a door and its manual door locking element, said control circuit comprising:

a plurality of position switches (19) respectively coupled to each of said motors, each of said switches having a movable contact (12,14) which is actuated by its associated motor (10) from a first switch position (16) corresponding to the end position of said motor in a first rotational direction to a second switch position (15) corresponding to the end position of said motor (10) in the opposite rotational direction;

an operating switch (75) for simultaneously applying a voltage source to said motors;

means for electrically sensing the positions (15,16) of said movable contact (12,14) of said position switches (19);

first means responsive to said operating switch and said sensing means for selectively activating all of said motors having their respective movable contacts (12,14) in said first switch position (16) until their respective movable contacts (12,14) are moved into said second switch position (15); and, means responsive to said first means for activating all of said motors to move their respective movable contacts (12,14) from said second switch position (15) to said first switch position (16).

2. The control circuit according to claim 1, including a plurality of reversing switches (30) respectively coupled to each of said position switches for reversing the polarity of the voltage source applied to its associated motor (10).

3. The control circuit according to claim 2 wherein said motors respectively open and close a window pane (23) in said door in response to rotational motion of said motors.

4. The control circuit according to claim 2 wherein each of said position switches (19) comprises a two-way snap-action switch having a given hysteresis.

* * * * *